United States Patent [19]

Fukumori et al.

[11] 4,274,695

[45] Jun. 23, 1981

[54] DEVICE FOR ELECTRICALLY CONNECTING SPARK PLUG TO HIGH-VOLTAGE CABLE

[75] Inventors: Yukitsugu Fukumori, Yokohama; Masazumi Sone, Chigasaki; Hiromitsu Nagae, Katsuta; Masami Shida, Katsuta; Tsutomu Kooriyama, Katsuta; Koji Harada, Hitachi, all of Japan

[73] Assignees: Hitachi, Ltd.; Nissan Motor Company, Limited, both of Tokyo, Japan

[21] Appl. No.: 8,088

[22] Filed: Jan. 31, 1979

[30] Foreign Application Priority Data

| | | | |
|---|---|---|---|
| Feb. 3, 1978 | [JP] | Japan | 53-10461 |
| Mar. 24, 1978 | [JP] | Japan | 53-32987 |
| Aug. 2, 1978 | [JP] | Japan | 53-93572 |
| Oct. 13, 1978 | [JP] | Japan | 53-125069 |

[51] Int. Cl.[3] ..... H01R 13/514

[52] U.S. Cl. ..... 339/97 S; 339/147 P; 339/149 S; 339/213 S; 339/256 C

[58] Field of Search ..... 339/100, 147 P, 26, 339/149 S, 213 S, 217 SP, 218 S, 256 C, 258 C, 10, 97 S, 220 A, 223 S, 255 B, 263 S

[56] References Cited

U.S. PATENT DOCUMENTS

| | | | |
|---|---|---|---|
| 3,560,909 | 2/1971 | Wyatt et al. | 339/100 |
| 3,573,709 | 4/1971 | Elliott | 339/256 C X |
| 3,798,589 | 3/1974 | Deardurff | 339/256 C X |
| 3,867,001 | 2/1975 | Hedman | 339/149 S X |
| 4,136,922 | 1/1979 | Grebik | 339/223 S |

*Primary Examiner*—John McQuade
*Assistant Examiner*—John S. Brown
*Attorney, Agent, or Firm*—Craig and Antonelli

[57] ABSTRACT

A device for electrically connecting a spark plug to a high-voltage cable supplying a high voltage to the spark plug from an ignition coil, comprising a connecting member whose maximum length in the axial direction of the spark plug is selected to be not longer than 25 mm so as to reduce the antenna effect in the area including the connecting member thereby minimizing undesirable radiation of noise which provides radio interference against other electronic units.

25 Claims, 16 Drawing Figures

DEVICE FOR ELECTRICALLY CONNECTING SPARK PLUG TO HIGH-VOLTAGE CABLE

This invention relates to a device for electrically connecting a spark plug to a high-voltage cable supplying a high voltage to this spark plug from an ignition coil in a spark ignition system of an internal combustion engine of spark ignition type. More particularly, this invention relates to a device for electrically connecting the spark plug to the high-voltage cable with minimized radiation of noise.

In an ignition system of an internal combustion engine of spark ignition type, spark discharge occurring at the electrode gap in the spark plug and the distributor produces a radio frequency noise current which is radiated in the form of undesirable noises radiation to the exterior of the engine from the high-voltage cable acting as an antenna.

In order to prevent such radio interference, a high-resistance type high-voltage cable using a resistive cord of braided, wound or any other suitable configuration has been generally employed so that noise radiation from the high-voltage cable itself can be effectively suppressed.

However, due to the fact that a connecting member is generally provided at one end of the high-voltage cable for electrically connecting the end of the high-voltage cable to the post portion of the associated spark plug, radiation of noises tend to radiate from the area including this connecting member in an amount which is not negligible from the viewpoint of suppression of radio interference. Especially, in the radio frequency range of 100 MHz to 500 MHz, the wavelength is very short, and the connecting member itself will even act as a sufficiently efficient antenna.

It is therefore a primary object of the present invention to provide a novel and improved device for electrically connecting a spark plug to a high-voltage cable in an ignition system of a spark ignition engine, which device can minimize undesirable radiation of noises from the area electrically connecting the spark plug to the high-voltage cable.

The present invention is based upon the finding that the antenna effect depends upon the length of the connecting member in the device electrically connecting the spark plug to the high-voltage cable and is featured by the fact that the maximum length of the connecting member in the axial direction of the spark plug is selected to be not longer than a predetermined value, preferably 25 mm so as to suppress the antenna effect in this area thereby minimizing undesirable radiation of radio interference noises from this area of the device.

In accordance with one aspect of the present invention, there is provided a device comprising connecting means disconnectably connectable with a spark plug for electrically connecting the spark plug to a high-voltage cable supplying a high voltage to the spark plug from an ignition coil, wherein the maximum length of the connecting means in the axial direction of the spark plug is selected to be not longer than 25 mm, and the connecting means is integrally combined with the high-voltage cable by a reinforcing means.

In accordance with another aspect of the present invention, there is provided a device comprising connecting means disconnectably connectable with a spark plug for electrically connecting the spark plug to a high-voltage cable supplying a high voltage to the spark plug from an ignition coil, wherein the distance between the connecting end of the core of the high-voltage cable and the associated end of the post portion of the spark plug, which distance represents the projected distance measured from the end of the post portion of the spark plug to the end of the core of the high-voltage cable on a plane extending in the axial direction of the spark plug, is selected to lie within the range of 0 mm to 25 mm, the maximum length of the connecting means in the axial direction of the spark plug being selected to lie within the specified range of the projected distance, and the connecting means and the high-voltage cable are integrally combined together by a reinforcing means.

The above and other objects, features and advantages of the present invention will be more clear from the following detailed description given with reference to the accompanying drawings, in which.

Preferred embodiments of the device for electrically connecting a spark plug to a high-voltage cable according to the present invention will be described with reference to the drawings. For a better understanding of the present invention, prior art defects will be pointed out with reference to FIG. 1 before describing the present invention in detail.

Figure 1:
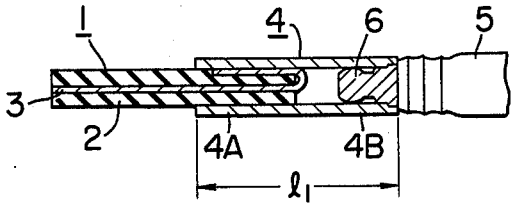
FIG. 1 PRIOR ART
FIG. 1 is a schematic sectional view of a prior art device for electrically connecting a spark plug to a high-voltage cable.

FIG. 1 shows the structure of a known device for electrically connecting a spark plug to a high-voltage cable. This known electrical connecting device shown in FIG. 1 comprises a cylindrical connecting member 4 of metal material mounted on one end of a high-voltage cable 1 composed of a sheath 2 of electrical insulator such as rubber and a core 3 of electrical conductor. The end portion of the exposed core 3 is turned over to extend along the outer surface of the sheath 2, and a caulking portion or crimping portion 4A of the connecting member 4 is then caulked to establish a firm connection between the cable 1 and the connecting member 4. A connecting portion 4B of the connecting member 4 is subsequently fitted on a post portion 6 of a spark plug 5 to establish a firm connection between the spark plug 5 and the connecting member 4 utilizing the resiliency of the connecting portion 4B of the connecting member 4.

It will be seen from FIG. 1 showing the structure of the prior art electrical connecting device that the caulking portion 4A of the connecting member 4 is required to have a large axial length in order to ensure a high mechanical strength at the connection between the cable 1 and the connecting member 4. It has thus been a common practice to select the total length $l_1$ of the connecting member 4 to be 60 mm to 70 mm or more. Therefore, the aforementioned antenna effect of the connecting member 4 has not been negligible from the viewpoint of suppression of radio interference. Due to, especially, the fact that the connecting member 4 is located nearest to the spark plug 5 which is the source of noise radiation, the area including the connecting member 4 and the spark plug 5 radiates a greatest amount of noise radiation.

Figure 2:
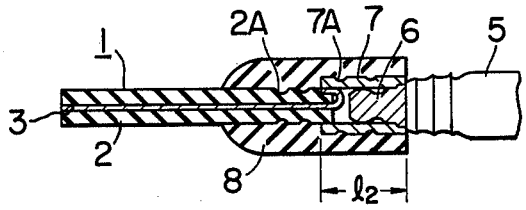
FIG. 2 is a schematic sectional view of an embodiment of the device comprising a connecting member for electrically connecting a spark plug to a high-voltage cable according to the present invention.

FIG. 2 shows an embodiment of the device for electrically connecting a spark plug 5 to a high-voltage cable 1 according to the present invention which obviates the prior art defect. Referring to FIG. 2, the electrical connecting device comprises a generally cylindrical connecting member 7 of metal material which has a shortened caulking portion, and a molded member 8 molded from a heat-resisting electrical insulator material such as a heat-resisting rubber or synthetic resin surrounds the connecting member 7 and the associated cable end to serve as a reinforcing member which provides the desired mechanical strength at the connection between the high-voltage cable 1 and the connecting member 7. Therefore, the total length $l_2$ of the connecting member 7 can be shortened to be substantially equivalent to the length of the post portion 6 of the spark plug 5 so that the radiation of noise can be greatly reduced.

Concavities 7A and 2A may be formed on the outer surface of the connecting member 7 and sheath 2 respectively to be engaged by associated convexities formed on the inner wall of the molded member 8 so as to further ensure the firm engagement between the reinforcing member 8 and the connecting member 7 as well as between the reinforcing member 8 and the high-voltage cable 1.

Figure 3:
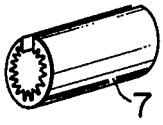
FIG. 3 is a schematic perspective view of a modification of the connecting member shown in FIG. 2.

The inner wall of the connecting member 7 may be serrated as shown in FIG. 3 so as to increase the crimping strength of the connecting member 7 caulked to the associated end portion of the high-voltage cable 1.

Figure 4:
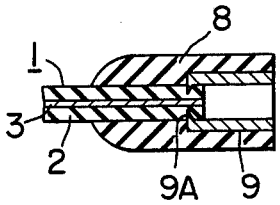
FIG. 4 is a schematic sectional view of a modification of the electrical connecting device shown in FIG. 2.

A connecting member 9 having a plurality of sharp-edged projections or lugs 9A at one end as shown in FIG. 4 may be used in lieu of the connecting member 7. In FIG. 4, the lugs 9A pierce through the sheath 2 to engage the core 3 during the caulking operation thereby establishing the desired connection between the core 3 and the connecting member 9.

The core 3 and the connecting member 7 may be bonded together by a conductive bonding agent so as to further increase the mechanical strength at the connection.

Figure 5:
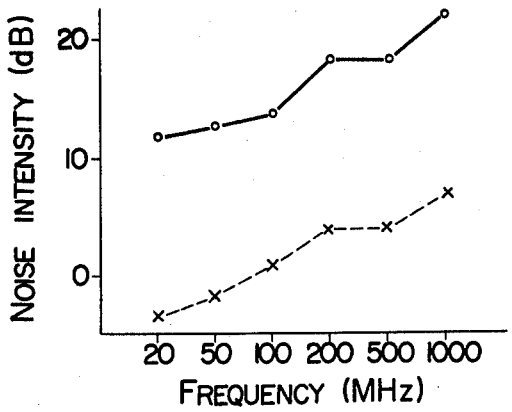
FIG. 5 is a graph showing the intensity of a radiation of noise radiated from the electrical connecting device of the present invention shown in FIG. 2 when compared with that of the prior art device shown in FIG. 1.

FIG. 5 is a graph showing the experimental results of measurement of the intensity of noise radiation radiated from the electrical connecting device of the present invention shown in FIG. 2 when compared with that of the prior art device shown in FIG. 1. The solid curve represents the values measured on the prior art device in which the total length $l_1$ of the connecting member 4 was 64 mm, while the dotted curve represents the values measured on the device of the present invention in which the total length $l_2$ of the connecting member 7 was 20 mm.

It will be seen from FIG. 5 that the intensity of noise radiation radiated from the device of the present invention is lower by about 10 dB to 15 dB than that of the prior art device over the entire measured frequency range between 20 MHz and 1000 MHz, and the device of the present invention is sufficiently effective in suppressing the radiation of noises.

Figure 6:
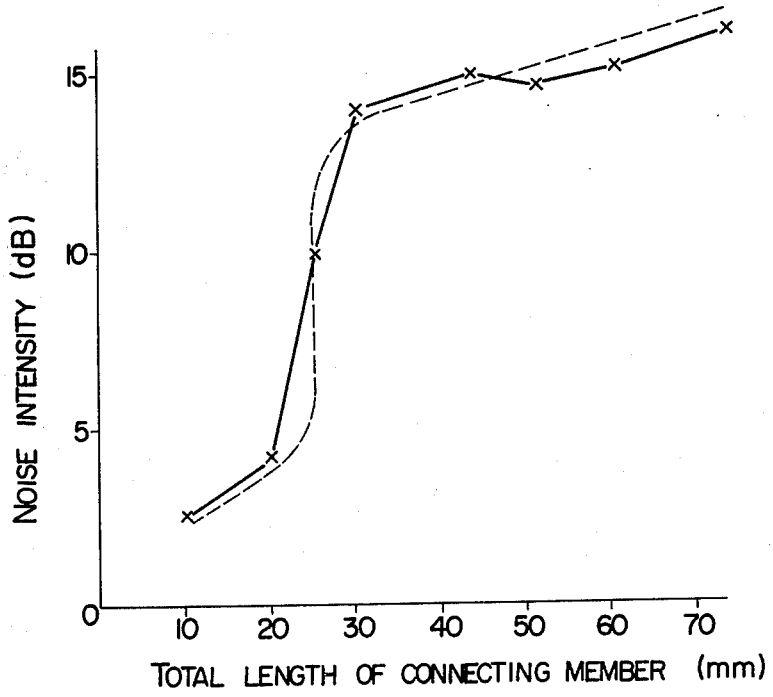
FIG. 6 is a graph showing the experimental results of measurement of the relation between the noise intensity and the maximum length of the connecting member in the electrical connecting device shown in FIG. 2.

FIG. 6 is a graph showing the relation between the radiation noise intensity and the total length of the connecting member 7 in the device of the present invention. The solid curve represents the actually measured values, while the dotted curve represents the expected values. It will be seen from FIG. 6 that the noise intensity is greatly reduced when the total length $l_2$ of the connecting member 7 is not longer than 25 mm. Therefore, the desired noise suppression effect is fully exhibited when the connecting member 7 has a maximum length which is selected to be not longer than 25 mm.

The device of the present invention may be combined with a noise preventive type of spark plug such as a spark plug having a built-in resistance so that the radio noise intensity can be further reduced.

The distance beween the end of the post portion 6 of the spark plug 5 and the associated end of the core 3 of the high-voltage cable 1 in FIG. 2 may lie within the range of 0 mm to +25 mm. This is because the total length $l_2$ of the connecting member 7 is 25 mm at the maximum, and thus, the distance between the end of the core 3 of the high-voltage cable 1 and the end of the post portion 6 of the spark plug 5 electrically connected to each other by the connecting member 7 may be selected to lie within the range between the remotest relative positions and the nearest relative positions.

It will thus be understood that the maximum length $l_2$ of the connecting member 7 in the axial direction of the spark plug 5 is preferably selected to be not longer than 25 mm in the electrical connecting device of the present invention, so that the antenna effect of the area including the connecting member 7 can be reduced thereby minimizing undesirable noise radiation.

Figure 7:
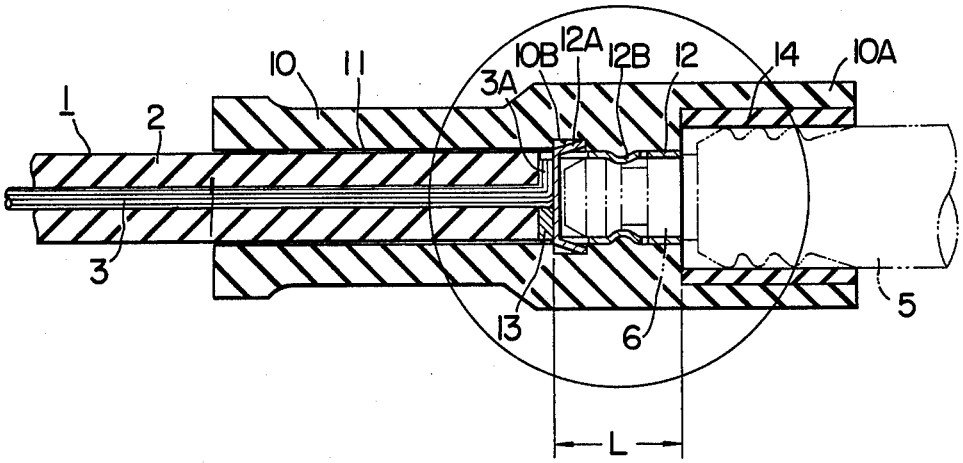
FIG. 7 is a schematic sectional view of another embodiment of the electrical connecting device according to the present invention.

A second embodiment of the electrical connecting device according to the present invention will be described with reference to FIG. 7. Referring to FIG. 7, a core 3 of a high-voltage cable 1 is in the form of, for example, a resistive cord obtained by impregnating glass fibers with carbon, and this core 3 is covered with a sheath 2 of heat-resisting, soft and pliable electrical insulator material such as chloroprene rubber. The end of the high-voltage cable 1 is inserted into a hollow reinforcing member or boot 10 of a hard electrical insulator material, and a bonding agent 11 is applied locally at least to the engaging surfaces of the high-voltage cable 1 and the boot 10 to firmly fix the end portion of the cable 1 within the boot 10. The end portion 3A of the core 3 exposed from the sheath 2 is bent to extend along the associated end of a connecting member 12 made of, for example, spring steel, and a conductive bonding agent 13 is applied between the exposed end portion 3A of the core 3 and the associated end of the connecting member 12 so as to firmly fix the exposed end portion 3A of the core 3 to the connecting member 12 and also to maintain the electrical connection therebetween.

As described previously, the total length L of the connecting member 12 in the axial direction of a spark plug 5 must be as short as possible so as to minimize radiation of noises therefrom. In order to shorten the total length L of the connecting member 12 without reducing the mechanical strength at the connection, it is necessary to provide suitable means capable of stably retaining the connecting member 12 within the boot 10 against the force of 10 N to 60 N imparted during urging the high-voltage cable 1 toward or away from the post portion 6 of the spark plug 5 to electrically connect or disconnect the former to or from the latter. This is because, when the holding force for the connecting member 12 is lowered due to the shortened total length L of the connecting member 12, the connecting member 12 will escape out of the boot 10 or will be displaced from the predetermined position in the boot 10, with the result that the electrical connection between the exposed end portion 3A of the core 3 and the post portion 6 of the spark plug 5 may become incomplete giving rise to an undesirable variation in the resistance value of the high-voltage cable 1.

In order to avoid the above trouble, the connecting member 12 is formed with an outwardly protruding portion 12A and formed also with a recess portion 12B having a contour mating with the shape of the post portion 6 of the spark plug 5. The boot 10 is formed at its inner wall with a shoulder or engaging portion 10B engageable with the outwardly protruding portion 12A of the connecting member 12.

The outwardly protruding portion 12A of the connecting member 12 comprises a plurality of pawls so that, when the connecting member 12 is urged to the predetermined position within the boot 10, the pawls of the outwardly protruding portion 12A of the connecting member 12 flare within the engaging portion 10B whose diameter is selected to be slightly larger than the largest outer diameter of the connecting member 12. Thus, the outwardly protruding portion 12A of the connecting member 12 is engaged by the engaging portion 10B of the boot 10 so that the connecting member 12 can withstand the force imparted during urging the high-voltage cable 1 toward or away from the spark plug 5. When so required, a bonding agent is applied to the engaging surfaces of the connecting member 12 and boot 10 to further increase the force fixing the connecting member 12 within the boot 10.

The material of the boot 10 is desirably a hard and heat-resisting electrical insulator material such as bakelite or a phenol resin, or a ceramic material such as alumina. Another material such as chloroprene rubber having a high hardness may also be used to form the boot 10. When the boot 10 is too soft and pliable, the bending force imparted frequently to the boot 10 during urging the high-voltage cable 1 toward or away from the post portion 6 of the spark plug 5 will cause displacement of the connecting member 12 relative to the exposed end portion 3A of the core 3 thereby deteriorating the electrical contact at this area and finally increasing the resistance value of the high-voltage cable 1 after a long period of time of use. Thus, the boot 10 of excessively soft and pliable material is undesirable. The inner diameter of the plug receiving end portion 10A of the boot 10 may be so selected tha the inner wall of such a portion 10A makes intimate engagement with the outer periphery of the insulator or the spark plug 5. Alternatively, a heat-resisting, soft and pliable rubber ring 14 making intimate engagement with the insulator of the spark plug 5 may be interposed between the spark plug 5 and the plug receiving end portion 10A of the boot 10, as shown in FIG. 7.

It will thus be understood that the total length L of the connecting member 12 in the axial direction of the spark plug 5 is selected to be as short as possible so as to minimize radiation of noises. For the positive attainment of this purpose, the maximum length L is desirably selected to be not longer than 25 mm.

Figure 8:
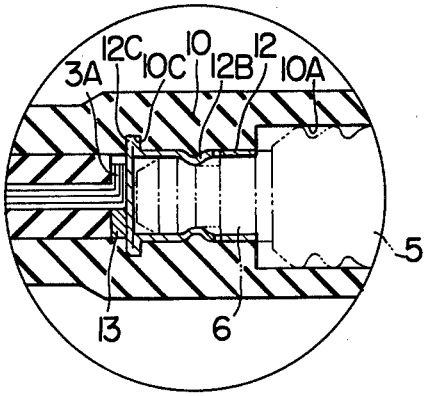
FIG. 8 is a schematic sectional view of part of a modification of the electrical connecting device shown in FIG. 7.

FIG. 8 shows part of a slight modification of the embodiment shown in FIG. 7. Referring to FIG. 8, a flange-like portion 12C protrudes outwardly from one end of the connecting member 12 to be received in an associated engaging portion **10*c* formed in the inner wall of the boot 10. The connecting member 12 can thus be safely and securely fixed in the predetermined position within the boot 10 against the external force such as the cable disengaging force, since the protruding portion 12*c* of the connecting member 12 is firmly received in the engaging portion 10*c* of the boot 10**.

Figure 9A:
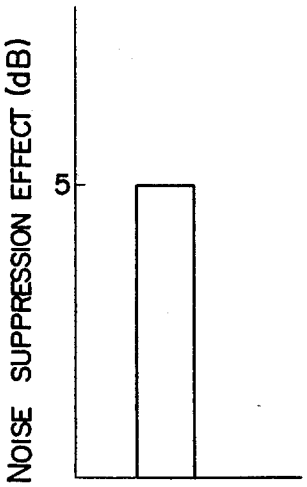
FIGS. 9A and 9B are graphs showing the experimental results of measurement of the effect of noise suppression in the electrical connecting device of the present invention shown in FIG. 7.
Figure 9B:
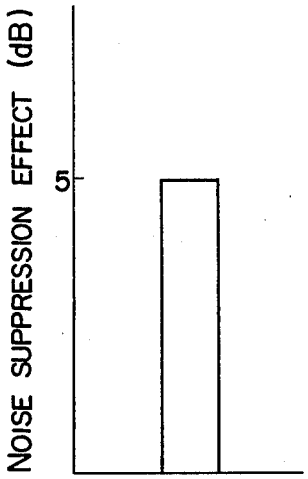

FIGS. 9A and 9B are graphs showing the noise suppression effect of the electrical connecting device of the present invention shown in FIG. 7. The noise suppression effect is represented by the mean value of noise intensities measured at a plurality of frequencies between 30 MHz and 1000 MHz. That is, the noise suppression effect is represented by (A-B) in dB, where A is the mean value of the noise intensities measured at those frequencies on the prior art electrical connecting device in which the total length L of the connecting member was 38 mm, while B is the mean value of the noise intensities measured at those frequencies on the electrical connecting device shown in FIG. 7 in which the total length L of the connecting member 12 was selected to be 11 mm.

FIG. 9A shows the radio noise suppression effect when the device shown in FIG. 7 is used to connect a standard spark plug to a high-voltage cable, while FIG. 9B shows the noise suppression effect when the device is used to connect a spark plug with a built-in resistance to a high-voltage cable.

It will be apparent from FIGS. 9A and 9B that the noise suppression effect of the electrical connecting device shown in FIG. 7 is higher by about 5 dB than that of the prior art electrical connecting device. It has been experimentally proved that the noise suppression or reduction effect of the device of the present invention is substantially uniform over the wide frequency range of from 30 MHz to 1000 MHz.

A third embodiment of the present invention will be described with reference to FIG. 10.

Figure 10:
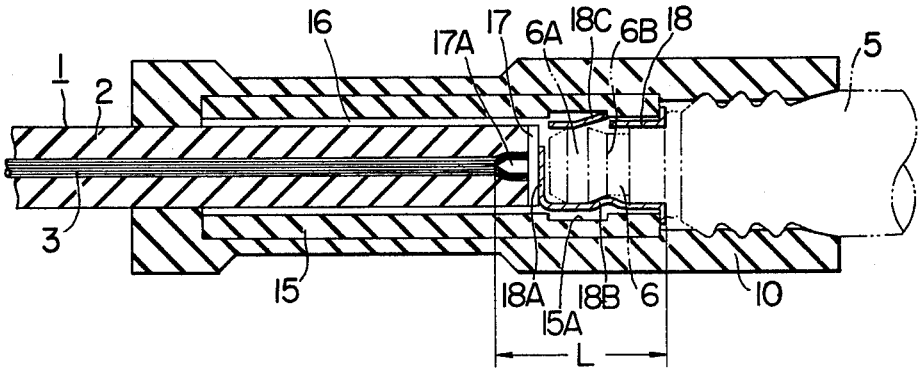
FIG. 10 is a schematic sectional view of still another embodiment of the electrical connecting device according to the present invention.

Referring to FIG. 10, a high-voltage cable 1 composed of a core 3 and a shield 2 of electrical insulator is fixedly received at its end portion in a hollow cylindrical boot 10 with a cylindrical holder 15 of heat-resisting hard electrical insulator material, such as bakelite or hard rubber, interposed therebetween. A bonding agent 16 is applied to the inner wall of the holder 15 and to the outer surface of the high-voltage cable 1, so that the holder 15 and the boot 10 act in combination as a reinforcing member. The end of the core 3 of the high-voltage cable 1 is disposed opposite to a needle 17A extending at right angles from a flat portion of a pin 17 of metal material, and this needle 17A is forced into the core 3 of the high-voltage cable 1 to be electrically connected to the core 3. The pin 17 may be made of a resistive material in lieu of the metal material. In such a case, it is necessary to coat the pin 17 with a conductive material or to suitably render the pin 17 conductive so as to ensure a good electrical connection between it and the core 3.

A connecting member 18 is inserted into the holder 15 from the open end of the latter to receive a post portion 6 of a spark plug 5, and its leading end portion 18A resiliently engages with the bottom of the flat portion of the pin 17 to be electrically connected to the pin 17. The connecting member 18 is made of a resilient metal material such as spring steel, and an inwardly inclining portion 18B and a pawl-like latch portion 18C are formed on the cylindrical body of the connecting member 18. The inwardly inclining portion 18B of the connecting member 18 engages resiliently with the small-diameter portion 6B of the post portion 6 of the spark plug 5, and the latch portion 18C of the connecting member 18 engages resiliently with the large-diameter portion 6A of the spark plug post portion 6. The free end of the latch portion 18C of the connecting member 18 flares outwardly to engage with a groove 15A formed in the inner wall of the holder 15, so that the connecting member 18 can be securely held in the predetermined position within the holder 15 against the force of about 60 N which may be imparted during insertion or withdrawal of the spark plug 5.

The total length L of the metal portion, that is, the distance between the piercing end of the needle 17A of the pin 17 and the bottom of the connecting member 18 in the embodiment shown in FIG. 10 is as short as about 13 mm, and this length L is only about $\frac{1}{2}$ or $\frac{1}{3}$ of the length L of the connecting member in the prior art electrical connecting device. Thus, the amount of radiated noises can be reduced to a level far lower than that radiated from the prior art device.

It will be apparent from the comparison between the prior art device and the device of the present invention that the total length L of the metal portion could be shortened since the present invention could eliminate the metal portion disposed around the high-voltage cable in the prior art device, and this could be attained by enclosing the high-voltage cable 1 in the holder 15 of heat-resisting hard electrical insulator material. The holder 15 of electrical insulator does not act as a noise radiating antenna, and the holder 15 of hard material withstands the external force of about 60 N imparted during urging the high-voltage cabble 1 toward or away from the post portion 6 of the spark plug 5 thereby ensuring trouble-free insertion or withdrawal. Further, the holder 15 of hard material does not undergo elastic deformation thereby preventing occurrence of a mal-contact at the electrical connection. It will thus be understood that the provision of the holder 15 in the electrical connecting device shown in FIG. 10 is effective in that the mechanical performance required for the electrical connector of this kind is substantially the same as that of the cylindrical connecting member 4 in the prior art device, and yet, the fatal defect of the cylindrical connecting member 4 which has acted as the noise radiating antenna can be substantially obviated.

A fourth embodiment of the present invention relates to another practical structure contemplated to shorten the total length of the electrical connecting device under consideration. In this fourth embodiment, the electrical connecting device is divided into a first connection part for connection to a high-voltage cable and a second connection part for connection to a spark plug, and the second connection part is disposed in a relation registered with the first connection part in a plane to establish the desired electrical connection between the high-voltage cable and the spark plug.

Figure 11:
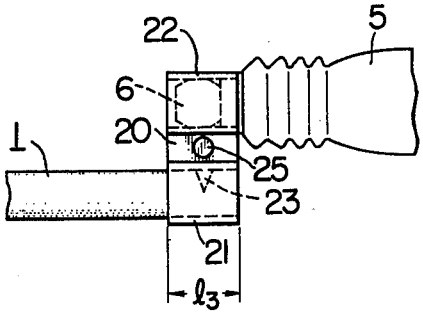
FIG. 11 is a schematic front elevational view of yet another embodiment of the electrical connecting device according to the present invention.
Figure 12:
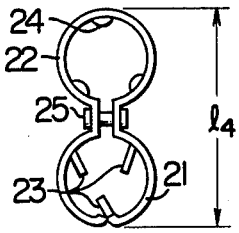
FIG. 12 is a schematic side elevational view of the electrical connecting device of the present invention shown in FIG. 11.

Referring now to FIGS. 11 and 12, a connecting member 20 comprises a first connection part 21 for connection to a high-resistance type high-voltage cable 1 and a second connection part 22 for connection to a spark plug 5, and these connection parts 21 and 22 are disposed in registered relationship as best shown in FIG. 12 with the longitudinal axes of each of the connection parts 21, 22 extending substantially in parallel. The end portion of the high-voltage cable 1 is received in the first connection part 21 of the connecting member 20, and an external fastening force is imparted to the connection part 21 to firmly hold the end portion of the cable 1 in the connection part 21 of the connecting member 20. A plurality of projections or teeth 23 adapted to pierce through the sheath of the cable 1 extend inwardly from the connection part 21 so as to prevent escapement of the cable 1 from the connecting member 20 and to ensure electrical connection between the connecting member 20 and the core of the cable 1.

A plurality of button-like ridges 24 are also formed along the inner periphery of the second connection part 22 of the connecting member 20 so as to improve the electrical contact with the post portion 6 of the spark plug 5 and also to prevent escapement of the post portion 6 of the spark plug 5 from the connecting member 20.

As shown in FIG. 12, the connecting member 20 is formed by bending a metal plate having a predetermined width into a figure 8-like shape and then imparting a fastening pressure to the central constricted portion of the figure 8 shape by a fastening pin 25. This fourth embodiment differs from the preceding embodiments in that the connecting member 20 itself serves also as the reinforcing member. Thus, for example, the teeth 23 and the pin 25 act as the reinforcing means.

Therefore, when the end portion of the high-voltage cable 1 is mounted in the connecting member 20, an additional fastening pressure may be imparted to the pin 25 to provide the desired mechanical strength at the connection between the cable 1 and the connecting member 20. Alternatively, after imparting the fastening pressure to the pin 25 to provide the shape shown in FIG. 12, the end portion of the cable 1 may be inserted into the first connection part 21 of the connecting member 20, and then, an external fastening force may be imparted to the connection part 21 to firmly fix the cable end portion in the connection part 21. The dimensions of these parts are so determined that, when the second connection part 22 is fitted on the post portion 6 of the spark plug 5, a predetermined contact pressure can be produced at each of the connection parts 21 and 22 by the resiliency of the connecting member 20 in each of the above cases.

The use of the connecting member 20 having such a structure is effective in that the total length $l_3$ in FIG. 11 is only about $\frac{1}{2}$ of the total length $l_1$ in FIG. 1, and the antenna effect can be correspondingly reduced. The registered arrangement of the first and second connection parts 21 and 22 may result in an increase in the vertical distance, that is, the distance $l_4$ in FIG. 12 compared with that of the prior art device. However, this distance $l_4$ is substantially equivalent to the length $l_3$ since the outer diameter of the post portion 6 of the spark plug 5 is about 8 mm, and the outer diameter of the cable 1 is also about 8 mm.

The inventors have conducted an experiment to compare the intensity of noise radiated from the electrical connecting device having $l_3=20$ mm and $l_4=19$ mm with that of the prior art device having $l_1=64$ mm. The results have proved that the noise intensity in the former is lower by about 10 dB from that in the latter.

The registered arrangement of the connection parts 21 and 22 of the connecting member 20 may give rise to such a trouble that a spark may jump from the end of the connection part 21 to the cylinder head depending on the shape of the spark plug receiving portion of the cylinder head. However, the above trouble can be obviated by changing the shape of the spark plug receiving portion of the cylinder head to increase the distance between the cylinder head and the end of the connection part 21, or by molding the end of the connection part 21 with a suitable electrical insulator material having a high resistance.

Figure 13:
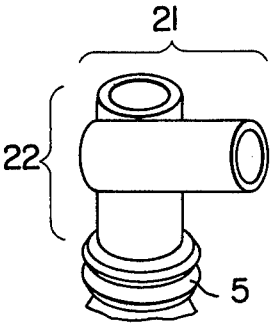
FIGS. 13, 14 and 15 are schematic perspective views of modifications of the embodiment shown in FIGS. 11 and 12.
Figure 14:
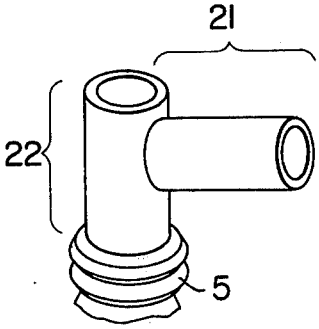

FIGS. 13 and 14 show modifications of the electrical connecting device shown in FIGS. 11 and 12. Referring to FIG. 13, the first connection part 21 is disposed in a substantially orthogonal relationship to the second connection part 22 and is partly welded to the side wall of the second connection part 22 to provide a reinforced integral structure. In FIG. 13, the first connection part 21 is welded directly to the side wall of the second connection part 22. However, means such as a bracket may be interposed therebetween.

Referring to FIG. 14, the first connection part 21 is welded at one end thereof to the side wall of the second connection part 22.

A suitable one of the embodiments shown in FIGS. 11, 13 and 14 can be selected depending on the arrangement of the spark plug relative to the cylinder block.

An experiment conducted by the inventors has proved that radiation of noises can be conspicuously reduced when the length of the second connection part 22 in these embodiments is selected to be not longer than 25 mm.

Figure 15:
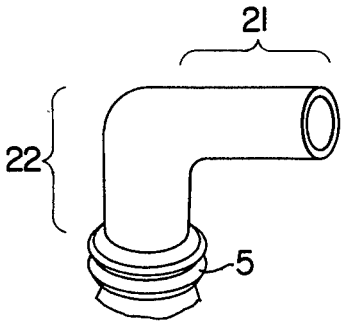

FIG. 15 shows another modification in which the length of the second connection part 22 is not longer than 25 mm, and the two connection parts 21 and 22 are integrally combined to each other.

In the embodiment shown in FIGS. 11 and 12, the distance between the end of the post portion 6 of the spark plug 5 and the end of the core 3 of the high-voltage cable 1 lies preferably within the same range as that described with reference to FIG. 2. More precisely, the projected distance measured from the end of the post portion 6 of the spark plug 5 to the end of the core 3 of the calbe 1 on a plane extending in the axial direction of the spark plug 5 lies preferably within the range of from 0 mm to 25 mm. This is because the maximum length $l_3$ of the connecting member 20 is 25 mm, and thus, the distance between the end of the post portion 6 of the spark plug 5 and the end of the core 3 of the cable 1 is 25 mm in their remotest relative positions and 0 mm in their nearest relative positions.

It will be understood from the foregoing detailed description of the present invention that the maximum length of the connecting member in the axial direction of the spark plug is selected to be not longer than 25 mm so that the antenna effect in this area can be effectively reduced, and undesirable radiation of noises from an internal combustion engine can be greatly suppressed.

What we claim is:

1. An electrical connecting device comprising connecting means disconnectedably connectable with a spark plug for electrically connecting the spark plug to a high-voltage cable supplying a high voltage to the spark plug from an ignition coil, wherein a maximum length of said connecting means in an axial direction of said spark plug is selected to be not longer than 25 mm, and said connecting means is integrally combined with said high-voltage cable by a reinforcing means.

2. An electrical connecting device as claimed in claim 1, wherein a core of said high-voltage cable is connected to said connecting means, and the reinforcing means includes a molded means of an electrical insulating material for integrally fixing said high-voltage cable and an associated end portion of said connecting means together.

3. An electrical connecting device as claimed in claim 2, wherein escape-proof concavities or convexities are formed on at least one of molded areas of said high-voltage cable and said reinforcing means for ensuring a firm connection therebetween.

4. An electrical connecting device as claimed in claim 1, wherein said connecting means is formed with an outwardly protruding portion, and the reinforcing means is formed as a hollow cylindrical boot having an engaging portion receiving said outwardly protruding portion of said connecting means for ensuring firm engagement with said connecting means, said hollow cylindrical boot externally covering the associated end portion of said high-voltage cable as well as said connecting means.

5. An electrical connecting device as claimed in claim 4, wherein said boot is made of a hard electrical insulator material such as bakelite, phenol resin or alumina.

6. An electrical connecting device as claimed in claim 1, wherein the end portion of said high-voltage cable and said connecting means are fixedly received within a hollow cylindrical holder, and wherein said reinforcing means is a hollow cylindrical boot externally covering said holder and said end portion of said high-voltage cable, said hollow cylindrical boot having an axial length which is longer than an axial length of said holder.

7. An electrical connecting device as claimed in claim 6, wherein a needle-like member is forced into a core of said high-voltage cable to electrically connect said high-voltage cable to said connecting means.

8. An electrical connecting device as claimed in claim 6, wherein said connecting means is formed with an outwardly protruding portion engageable with an engaging portion formed in said holder so that said connecting means can be firmly held within said holder.

9. An electrical connecting device as claimed in claim 6, wherein said holder is made of a hard electrical insulator material, and said boot is made of a soft electrical insulator material.

10. An electrical connecting device comprising connecting means disconnectably connectable with a spark plug for electrically connecting the spark plug to a high-voltage cable supplying a high voltage to the spark plut from an ignition coil, wherein a distance between a connecting end of a core of said high-voltage calbe and an associated end of a post portion of said spark plug, which distance represents a projected distance measured from the end of the post portion of said spark plug to the end of the core of said high-voltage calbe on a plane extending in an axial direction of said spark plug, is selected to lie within a ramge of 0 mm to 25 mm, a maximum length of said connecting means in the axial direction of said spark plug being selected to lie within said specified range of said projected distance, and said connecting means and said high-voltage cable are integrally combined together by a reinforcing means.

11. An electrical connecting device as claimed in claim 10, wherein said connecting means is divided into a first connection part for connection to said high-voltage cable and a second connection part for connection to the post portion of said spark plug, and said first connection part is disposed on one side of said second connection part to be electrically connected to the latter in such a relationship.

12. An electrical connecting device as claimed in claim 11, wherein said first and second connection parts are arranged in a relationship in which a longitudinal axis of said first connection part extends substantially in parallel to a longitudinal axis of said second connection part.

13. An electrical connecting device as claimed in claim 11, wherein said first and second connection parts are arranged in a relationship in which an axis of said first connection part extends substantially orthogonal to an axis of said second connection part.

14. An electrical connecting device as claimed in claim 11, wherein said first connection part is provided with a plurality of teeth adapted to pierce into said high-voltage cable.

15. An electrical connecting device as claimed in one of claims 2 or 3, wherein escapeproof concavities or convexities are formed on at least one of the reinforcing means and the connecting means for ensuring a firm engagement therebetween.

16. An electrical connecting device as claimed in claim 2, wherein an inner wall of the connecting means is provided with serrations for increasing the crimping strength between said high voltage cable and the associated end portion of said connecting means.

17. An electrical connecting device as claimed in claim 2, wherein the end portion of the connecting means includes a plurality of sharp-edged projection means adapted to pierce through an outer sheath of the high-voltage cable and penetrate the core thereof.

18. An electrical connecting device as claimed in claim 4, wherein the engaging portion of the boot is formed as a shoulder having an inner wall engageable with the outwardly protruding portion of the connecting means.

19. An electrical connecting device as claimed in claim 4, wherein the outwardly protruding portion is formed as a plurality of pawls adapted to flare within the engaging portion of the boot.

20. An electrical connecting device as claimed in claim 4, wherein the connecting means includes a recess portion having a contour adapted to mate with a post portion of the spark plug.

21. An electrical connecting device as claimed in one of claims 4, 18, 19, or 20, wherein the boot has a sufficient axial length so as to extend over an insulator portion of the spark plug, and wherein a heat resisting soft pliable rubber ring is interposed between the insulator portion of the spark plug and the boot.

22. An electrical connecting device as claimed in claim 21, wherein the boot is made of chloroprene rubber.

23. An electrical connecting device as claimed in claim 4, wherein the outwardly protruding portion of the connecting means is a flange adapted to be received in the engaging portion formed in the boot.

24. An electrical connecting device as claimed in claim 8, wherein the connecting means is made of a resilient metal material and further includes an inwardly inclining portion adapted to resiliently engage a small diameter portion of a post portion of the spark plug, and a pawl-like latch portion resiliently engageable with a large diameter post portion of the spark plug, the latch portion includes a free end defining the outwardly protruding portion of the connecting means.

25. An electrical connecting device as claimed in claim 24, characterized in that the resilient metal material is spring steel.

* * * * *